US005924174A

United States Patent [19]

Mizuno

[11] Patent Number: 5,924,174

[45] Date of Patent: Jul. 20, 1999

[54] SLIDER OF SLIDE FASTENER WITH AUTOMATIC LOCKING MECHANISM

[75] Inventor: Hiroshi Mizuno, Toyama, Japan

[73] Assignee: YKK Corporation, Tokyo, Japan

[21] Appl. No.: 09/015,315

[22] Filed: Jan. 29, 1998

[30] Foreign Application Priority Data

Jan. 31, 1997 [JP] Japan ..... 9-018535

[51] Int. Cl.[6] ..... A44B 19/30

[52] U.S. Cl. ..... 24/421

[58] Field of Search ..... 24/420–422, 424

[56] References Cited

U.S. PATENT DOCUMENTS

| | | | |
|---|---|---|---|
| 4,139,928 | 2/1979 | Aoki et al. . | |
| 5,255,418 | 10/1993 | Chen | 24/421 |
| 5,694,667 | 12/1997 | Mizuno | 24/421 |

FOREIGN PATENT DOCUMENTS

| | | |
|---|---|---|
| 0 612 486 A1 | 8/1994 | European Pat. Off. . |
| 0 745 338 A2 | 12/1996 | European Pat. Off. . |

*Primary Examiner*—James R. Brittain

*Attorney, Agent, or Firm*—Hill & Simpson

[57] ABSTRACT

In a slider of a slide fastener with an automatic locking mechanism, the slider comprises a slider body composed of upper and lower wings joined together at their front ends by a guide post, a cover-attaching lug located on an upper surface of the upper wing near a front opening of the slider body and having a longitudinal center groove, a recess formed in the bottom of the groove so as to sink into the guide post, a pair of stepped sections at a top of the lug, and a low wall section at a front of the lug, an S-shaped leaf spring having a resilient portion to be received in the groove, a protuberant portion at an end thereof to be placed on the stepped sections, a cover having at least one ridge-like projection, a number of small projections, which are provided at a center of an inner surface thereof respectively, and bent ridges formed at front and rear corners, in which the bent ridges are received in the groove so as to engaged in the a cover-attaching lug, a pair of protuberances and an axial protuberance of the protuberant portion abut with the bent ridges and the ridge-like projection, respectively, so that a locking pawl of the leaf spring can project into or out of the slider body. Thus, the leaf spring having a strong resiliency can be stably housed in the slider.

17 Claims, 5 Drawing Sheets

SLIDER OF SLIDE FASTENER WITH AUTOMATIC LOCKING MECHANISM

BACKGROUND OF THE INVENTION

1. [Field of the Invention]

This invention relates to a slider of a slide fastener having an automatic locking mechanism realized by arranging a leaf spring fitted to the slider body and having a locking pawl and a U-shaped resilient portion disposed respectively at the opposite ends thereof such that the slider slidingly moves as the pull tab is manually operated and automatically stops once the pull tab is released.

2. [Prior Art]

FIG. 7 of the accompanying drawings schematically illustrates a known slider of a slide fastener having an automatic locking mechanism of the type under consideration and disclosed by Japanese Patent Application Laid-Open No. 8-32261. It comprises a cover 3' having a pair of inner projections 35', 35' arranged longitudinally at the center of the inner surface thereof, a leaf spring 2' having a locking pawl 27' located at an end thereof, a pair of laterally extending protuberances 29', 29' and a resilient portion 28' extending between the locking pawl 27' and the protuberances 29', 29', a slider body 1' having a front attachment lug 10' located near the front opening of the slider body 1' and standing from a front area of the upper surface of the upper wing 5' of the slider body 1', said front attachment lug 10' having a central groove 12' and side recesses 55 arranged at the top of the front attachment lug 10' for receiving said protuberances 29', 29' respectively, a rear attachment lug 11' located near the rear opening of the slider body 1' and standing from a rear area of the upper surface of the upper wing 5' of the slider body 1', said rear attachment lug 11' having a vertical groove 21', a locking-pawl-insertion hole 24' for allowing the locking pawl 27' of the leaf spring 2' to pass therethrough and project into a guide channel, and a pull tab 4' having an axle 37' at an end thereof. The automatic locking mechanism of the slide fastener is constituted by said projections, 35', 35' of the cover 3', the leaf spring 2' and the front and rear attachment lugs 10', 11' and the locking-pawl-insertion hole 24' of the slider body 1' such that the protuberances 29', 29' of the leaf spring 2' are received in and preliminarily secured by the respective transversal recesses of the front and rear attachment lugs 10', 11' and the U-shaped resilient portion 28' of the leaf spring 2' is received in the central groove 12' of the front attachment lug 10' with the axle 37' of the pull tab 4' held between the leaf spring 2' and said slider body 1' while the locking pawl 27' of the leaf spring 2' is made to constantly project through the locking-pawl-insertion hole 24' of the slider body 1' into the guide channel 9' of the slider body 1' with the front end of the resilient portion 28' of the leaf spring 2' held in abutment with the projections 35', 35' on the inner surface of the cover 3' as the projections 35', 35' are received in the central groove 12' of the front attachment lug 10'.

The known slider of a slide fastener with an automatic locking mechanism as described above by referring to FIG. 7 is accompanied by a problem that it is practically impossible to make the slider including the cover show a low or thin profile due to the construction of the slider. Particularly, the U-shaped resilient portion 28' of the S-shaped leaf spring 2' is dimensionally restricted because it has to be accommodated in the narrow space defined by the attachment lugs 10', 11', so that a strong and highly resilient material cannot be used for it. Hence, such an automatic locking mechanism does not allow easy operation nor provide an reliable automatic locking effect. Additionally, the mechanism is rather complicated and involves a difficult assembling operation because the resilient portion 28' has to be securely held in position by the projection 35' of the cover 3' projecting into the groove 12' of the front attachment lug 10' with its protuberances 29', 29' received in the recesses 55 of the front attachment lug 10'.

SUMMARY OF THE INVENTION

In view of the above-mentioned problems of the known slider of a slide fastener, it is therefore an object of the present invention to provide a slider of a slide fastener with an automatic locking mechanism, wherein the slider is made to show a compact and low profile and the U-shaped resilient portion of the S-shaped leaf spring fitted to the slider body has an extended extremity and is deeply curved to provide an easy and strong resiliency which effectively serves the automatic locking mechanism, while the slider can be processed and assembled without difficulty.

Another object of the present invention is to provide a slider of a slide fastener with an automatic locking mechanism, wherein the slider body and the cover can be assembled easily and reliably and the leaf spring is allowed to fully exert its potential.

A still another object of the present invention is to provide a slider of a slide fastener with an automatic locking mechanism, wherein the cover is profiled to securely and reliably accommodate various leaf springs of various forms and to effectively prevent the leaf spring from being unnecessarily pulled beyond its limit of elasticity and deformed to lose its resiliency.

A further object of the present invention is to provide a slider of a slide fastener with an automatic locking mechanism, wherein the cover-attaching lug of the slider body is specifically profiled in such a way that the leaf spring may be easily and stably mounted onto the lugs on the slider body in the assembling process to improve the efficiency of the assembling, and the leaf spring mounted on the slider may function in a stable manner to fully exert its potential of resiliency.

A still further object of the present invention is to provide a slider of slide fastener with an automatic locking mechanism, wherein the slider body may be provided with various leaf springs of various forms adapted to the respective covers of various forms to be mounted on the slider body in such a way that the leaf spring may accurately and smoothly function between the slider body and the cover.

According to this invention, the above objects and other objects of the invention are achieved by providing a slider of a slide fastener with an automatic locking mechanism, comprising: a slider body composed of upper and lower wings joined together at their front ends by a guide post so as to define between the upper and lower wings a fastener-element guide channel, the upper wing having a locking-pawl-insertion hole communicating with the fastener-element guide channel; a cover-attaching lug located on an upper surface of the upper wing near a front opening of the slider body, the lug including a pair of stepped sections, a longitudinal center groove, a recess formed in the bottom of the groove so as to sink into the guide post, and a low wall section arranged in front of the groove so as to block the groove; a support lug located on the upper surface of the upper wing near a rear opening of the slider body; an S-shaped leaf spring having a locking pawl at an end thereof, a U-shaped resilient portion, a protuberant portion at the opposite end; a cover having at least one ridge-like projection projecting downward from an inner surface; and a pull-tab having an axle, wherein the U-shaped resilient portion of the S-shaped leaf spring is received in the groove of the cover-attaching lug, the protuberant portion laterally projecting at the opposite end is placed on the stepped sections respectively, an end of the protuberant portion abutting with the ridge-like projection of the cover at a position outside the cover-attaching lug, and the cover is placed over the cover-attaching lug and the support lug of the slider body after the axle of the pull tab is placed between the slider body and the leaf spring so as that the locking pawl at the end of the leaf spring normally projects into the guide channel through the locking-pawl-insertion hole of the slider.

Preferably, the cover further includes a pair of bent ridges arranged at a front and rear inner corners between a top wall and each of front and rear walls of the cover and having a profile adapted to that of the groove of the cover-attaching lug so that the ridges are received in the groove without forming any step between the wall section of the slider body and the inner surface of the cover.

Alternatively, the ridge-like projection of the cover is in a flat form extending centrally and fully between the lateral walls of the cover, and a pair of small projections being formed at front and rear ends of the flat central projection and projecting toward the corresponding inner corners of the cover-attaching lug, the flat central projection and the small projections projecting downwardly as low as a top edge of the axle-receiving slots of the lateral walls of the cover to abut on the leaf spring.

Still alternatively, the ridge-like projection of the cover is in a form of a sharp transversal ridge extending between the lateral walls of the cover and formed on the front and rear portions of a top inner surface of the cover, respectively, so as to project toward the corresponding inner corners of the cover-attaching lug and to abut on the leaf spring, the cover having a center flat portion between the sharp transversal ridges extending above and along a top edge of axle-receiving slots.

Preferably, the stepped sections are formed in a rear area of a top of the cover-attaching lug at a side toward the rear opening of the slider body and have respective slopes rising toward the respective inner corners so that the lateral protuberances of the protuberant portion of the leaf spring may be held in the stepped sections respectively.

Alternatively, the stepped sections are formed in a rear area of a top of the cover-attaching lug at a side toward the rear opening of the slider body and are in horizontal form extending to the respective inner corners so that the lateral protuberances of the protuberant portion of the leaf spring may be held in the stepped sections respectively.

Preferably, the protuberant portion at an end of the S-shaped leaf spring has an axial protuberance projecting from a center of the protuberant portion in addition to a pair of the lateral protuberances so as to form a cross, and the locking pawl at the opposite end thereof, such that the lateral protuberances of the protuberant portion of the leaf spring abut with the respective small projections of the cover and the axial protuberance of the leaf spring abut with the ridge-like projection of the cover.

Alternatively, the leaf spring simply has a pair of lateral protuberances and the locking pawl at the opposite end thereof, such that the lateral protuberances of the protuberant portion of the leaf spring abut with the ridge-like projection extending between the lateral walls and on the top inner surface of the cover.

DETAILED DESCRIPTION OF THE PREFERRED EMBODIMENTS

Now, the invention will be described in greater detail by referring to the accompanying drawings that illustrate preferred embodiments of slider of a slide fastener having an automatic locking mechanism according to the invention.

Figure 1:
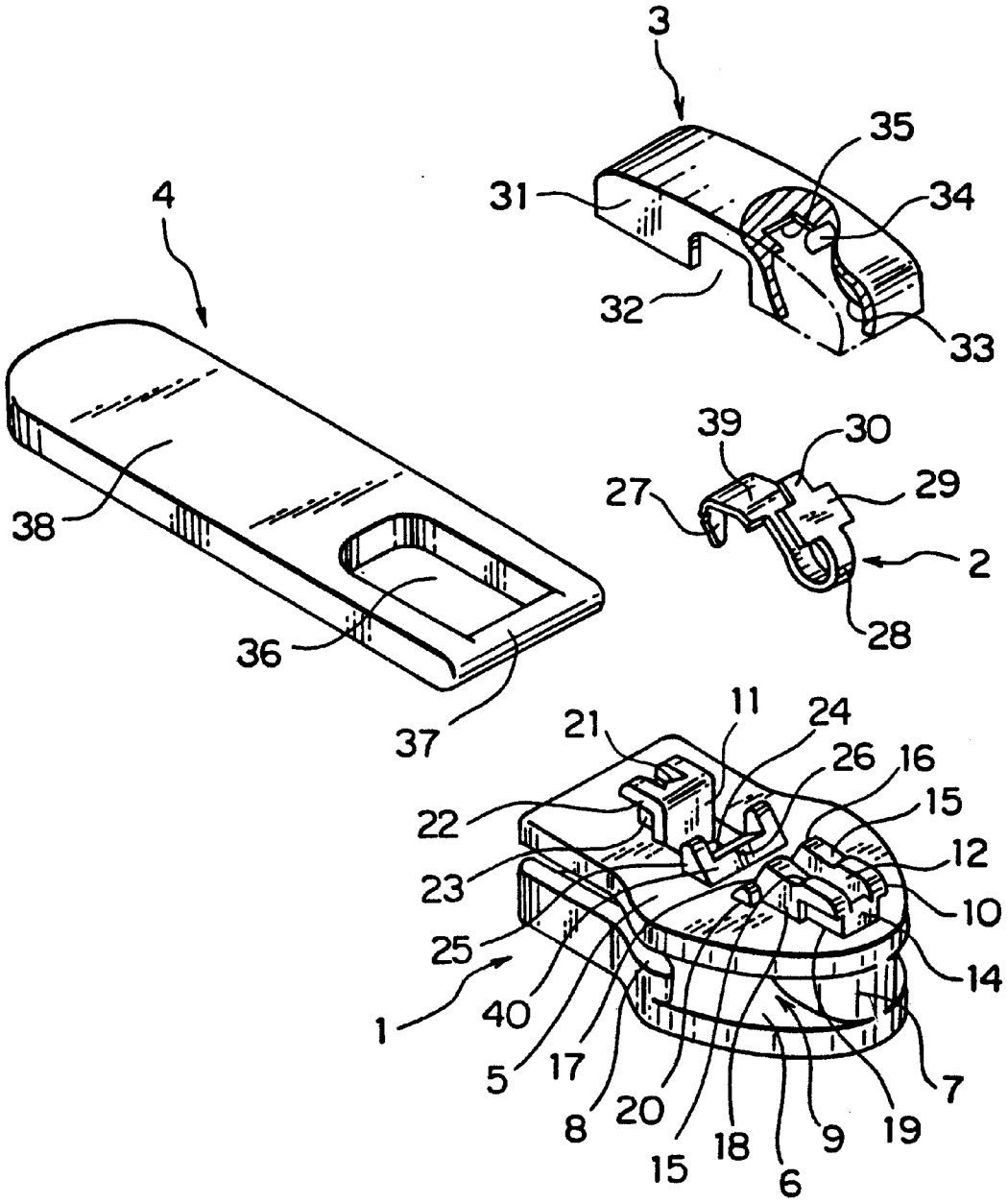
FIG. 1 is an exploded schematic perspective view of an embodiment of slider of a slide fastener having an automatic locking mechanism according to the invention.
Figure 2:
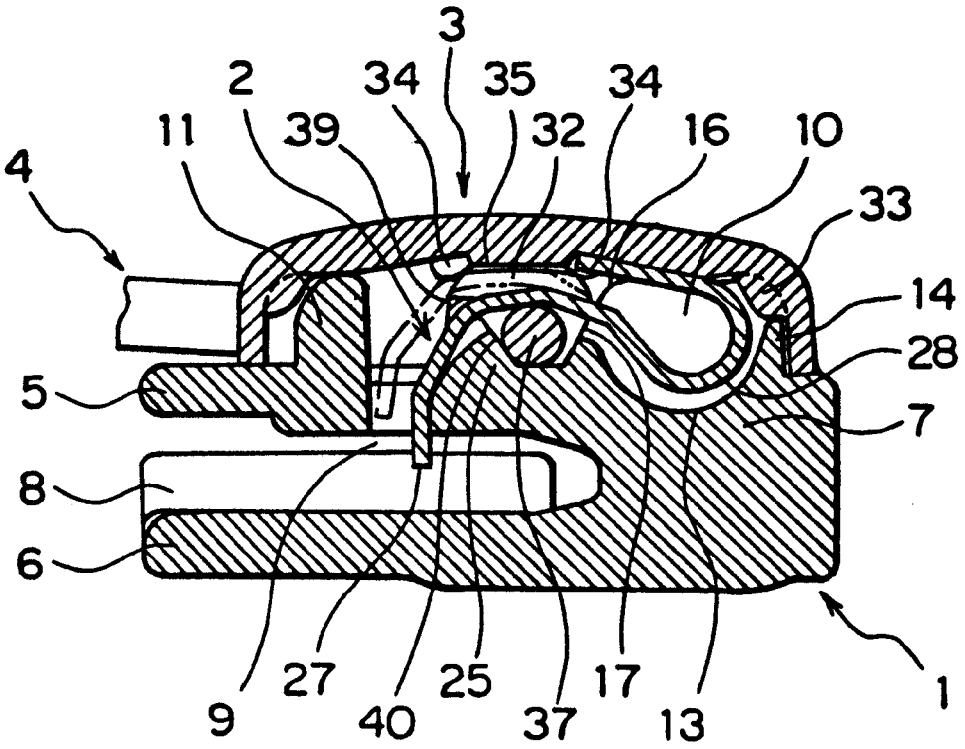
FIG. 2 is a longitudinal cross sectional side view of the embodiment of slider of FIG. 1.

FIG. 1 shows a slider of a slide fastener having an automatic locking mechanism according to the invention. Referring to FIG. 1, the slider is composed of four members, i.e. a slider body 1, a leaf spring 2, a cover 3 and a pull tab 4. The slider body 1, the cover 3 and the pull tab 4 may preferably be moleded by die cast with an aluminum alloy or a zinc alloy.

As seen from FIG. 1, the slider body 1 is formed by connecting an upper wing 5 and a lower wing 6 by means of a guide post 7, and the lower wing 6 is provided with a pair of bent guide flanges 8, 8 at the respective lateral sides thereof and also with a guide channel 9 for guiding fastener elements. The upper wing 5 has a cover-attaching lug 10 standing on an upper surface thereof near a front opening of the slider body 1 for securely holding the cover 3, and a support lug 11 standing on the upper surface thereof near a rear opening of the slider body 1 also for securely holding the cover 3.

The cover-attaching lug 10 has a longitudinal center groove 12 and an arcuate recess 13 which is formed in the bottom of the groove 12 so as to sink into a top of the guide post 7. The cover-attaching lug 10 further has a low wall section 14 in front of the groove 12 so as to continuous to the recess 13 to block the groove 12. A pair of stepped sections 15, 15 are formed on a top of the lug 10 each having a cut out portion at a side toward the rear opening of the slider body 1, each having a slope rising toward a corner 16 located at an inner or the rear-opening side. Further, the cover-attaching lug 10 has on a pair of rear end surfaces thereof a pair of sloped guide surfaces 17, 17 respectively sloping down toward the upper wing 5 for guiding the axle 37 of the pull tab 4. The lug 10 additionally has a pair of rectangular cut-off sections 19, 19 at opposite front base portions of walls 18, 18 thereof, and has at a base of the guide surfaces 17, 17 a pair of guide projections 20, 20 projecting laterally therefrom and having slopes in correspondence with the slopes of the guide surfaces 17, 17.

The support lug 11 standing from a rear area of the upper surface of the upper wing 5 has an engaging groove 21 having the same width as that of the groove 12 of the lug 10 and formed on the rear end surface of the support lug 11 so as to extend down to the upper wing 5. Additionally, the support lug 11 has at rear base portions of opposite walls 22, 22 thereof a pair of rectangular cut-off sections 23, 23. On the other hand, the upper wing 5 has a locking-pawl-insertion hole 24 located in front of the support lug 11 for allowing the locking pawl 27 of the leaf spring 2 to pass therethrough and get in the guide channel 9 of the slider body 1.

The upper wing 5 further has a wide guide projection 25 located between the locking-pawl-insertion hole 24 and the lug 10. The guide projection 25 has a sloped guide surface 40 located vis-a-vis the lug 10. Additionally, the guide projection 25 has at its top thereof a laterally extending U-shaped recess 26 which is slightly inclined toward the locking-pawl-insertion hole 24 so that an actuating section 39 of the S-shaped leaf spring 2 may slidably abut on the bottom of the recess 26.

As shown in FIG. 1, the leaf spring 2 has a substantially S-shaped profile, and has at an end thereof with a locking pawl 27 and at the opposite end thereof with a U-shaped resilient portion 28. The resilient portion 28 has such a width as to be snugly received in the groove 12 of the lug 10 and is provided at the free end thereof a pair of lateral protuberances 29, 29, which are adapted to be placed on the respective stepped sections 15, 15 of the lug 10 and secured by the stepped sections 15, 15 and the ridge-like projection 35 of the cover 3. The leaf spring 2 also has an axial protubrance 30 projecting from the center of the pair of lateral protuberances 29, 29 to form a cross together with a pair of lateral protuberances 29, 29. The leaf spring 2 has an actuating section 39 between the U-shaped resilient portion 28 and the locking pawl 27, the actuating section 39 having a relatively large width so that it may be snugly received in and slidingly abut on the bottom of the U-shaped recess 26 of the guide projection 25.

Figure 3:
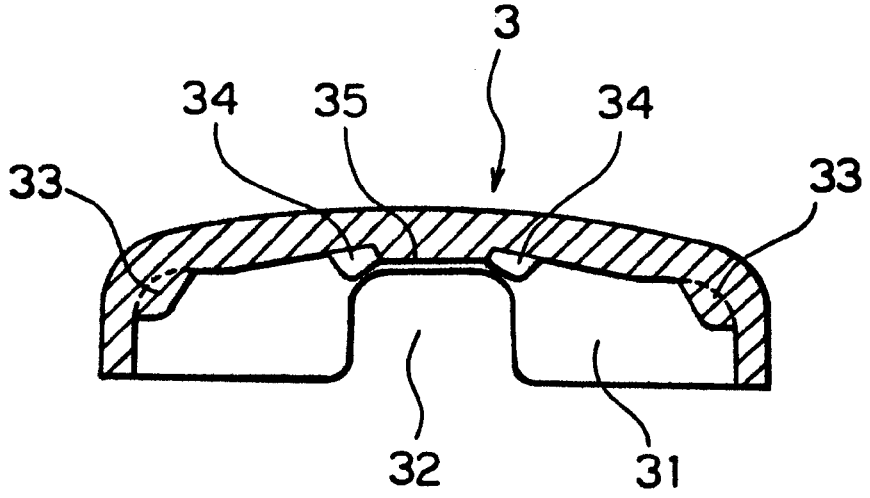
FIG. 3 is a longitudinal cross sectional side view of the cover of the embodiment of FIG. 1.
Figure 4:
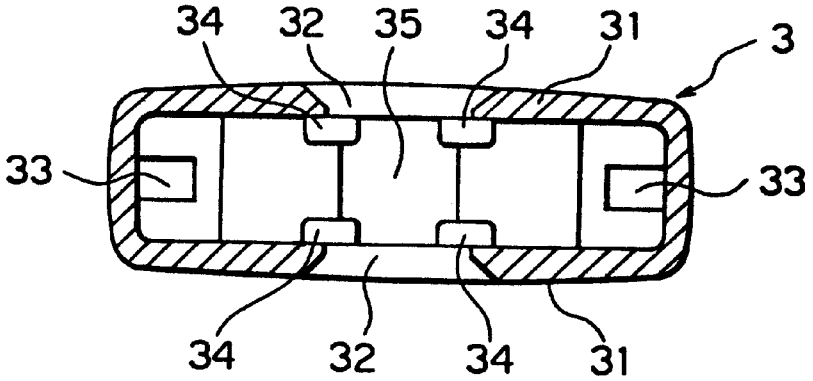
FIG. 4 is a longitudinal cross sectional bottom view of the cover of the embodiment of FIG. 1.

As seen from FIGS. 3 and 4, the cover 3 has axle-receiving slots 32, 32 formed at the respective centers of lateral walls 31, 31 of the cover 3 for receiving the axle 37 of the pull tab 4 and also a pair of bent ridges 33, 33 projecting respectively from the front and rear corners between the top wall and each of front and rear walls of the cover 3 and having the same width as that of the groove 12 of the lug 10. The ridge 33 is snugly received in the groove 12 without forming any step between the wall section 14 of the lug 10 and the bent ridge 33 of the cover 3 when the cover 3 is placed over the slider body 1.

The top of the cover 3 is so profiled from the front end toward the middle as to come into contact with the slopes of the stepped sections 15, 15 to help a forward and backward movement of the leaf spring 2 due to its resiliency when the leaf spring 2 is placed on the sections 15, 15. Additionally, the cover 3 has a pair of small projections 34, 34 at the lateral sides of the cover 3 at positions confronting with the corners 16, 16 of the lug 10 so as to abut with the side edges of the lateral protuberances 29, 29 of the leaf spring 2. The cover 3 further has a flat central projection 35 formed at a center of the inner surface of the cover 3 extending fully between the small projections 34, 34 so that, when assembled, it abuts on the front end of the axial protuberance 30 of the leaf spring 2. The small projections 34, 34 are formed at corners of the opposite ends of the flat central projection 35 standing at the center of the cover 3, so that the small projections 34, 34 are located symmetrically with respect to the center of the cover 3. The flat central projection 35 and the small projections 34, 34 are made to project to such an extent that they get to a top edge of the level of the axle-receiving slots 32, 32 so that, when the pull tab 4 is pulled, the leaf spring 2 abuts on the surface of the ridge-like projection 35 and those of the small projections 34, 34.

The pull tab 4 has a substantially rectangular flat profile and a through hold 36 so as to form an axle 37 at an end and a tab section 38 at the opposite end, as shown in FIG. 1. The axle 37 is placed between the lug 10 and the guide projection 25 on the upper wing 5 and also between the slider body 1 and the leaf spring 2. The through hole 36 of the pull tab 4 has such a contour that when assembled, the cover 3 can pass through the through-hole 36 so that the pull tab 4 can be pivotally moved.

The above described components of the slider are assembled in a manner as described below. Firstly, the axle 37 of the pull tab 4 is placed between the lug 10 and the guide projection 25 on the upper wing 5 of the slider body 1, and then the S-shaped leaf spring 2 is placed over so as that the lateral protuberances 29, 29 are placed on the respective sections 15, 15 of the lug 10, while the U-shaped resilient portion 28 is received in the groove 12 of the cover-attaching lug 10 and the relatively wide actuating section 39 of the leaf spring 2 is inserted into the U-shaped recess 26 of the guide projection 25 on the upper wing 5 so that the locking pawl 27 of the leaf spring 2 is led into the locking-pawl-insertion hole 24 of the slider body 1 until its front end projects into the guide channel 9.

Then, the cover 3 is placed over in such a manner that the axle-receiving slots 32, 32 of the cover 3 are aligned with the axle 37 of the pull tab 4 and one of the ridges 33, 33 is inserted into the groove 12 of the lug 10, while the other ridge 33 is inserted into the engaging groove 21 of the support lug 11 until the small projections 34, 34 and the ridge-like projection 35 of the cover 3 respectively abut on the corresponding lateral protuberances 29, 29 and the axial protuberance 30 of the leaf spring 2. Then, the front and rear corners of the lateral walls 31 of the cover 3 are respectively pressed against the rectangular cut-off sections 19, 19 of the lug 10 and the rectangular cut-off sections 23, 23 of the support lug 11. Thus, the cover 3 is securely held by the slider body 1 to cover the latter and complete the operation of assembling the first embodiment of the slider of a slide fastener having an automatic locking mechanism according to the invention.

Once assembled, when the pull tab 4 is pulled either forward or backward, the axle 37 of the pull tab 4 of the embodiment can be guided by the guide planes 17, 17 of the lug 10 and the guide surface 40 of the guide projection 25 until the leaf spring 2 abuts on the ridge-like projection 35 of the cover 3, then the U-shaped resilient portion 28 of the leaf spring 2 is compressed to raise the locking pawl 27 and remove the latter from the guide channel 9, so the slider can be slidingly moved back and forth.

When the pull tab 4 of the slider is released, then the U-shaped resilient portion 28 of the leaf spring 2 presses down the axle 37 of the pull tab 4 along the guide surfaces 17, 17 of the lug 10 and the guide surface 40 of the guide projection 25 and causes the locking pawl 27 to project back into the guide channel 9 and further between the fastener elements, thus mutual engagement of the locking pawl 27 and the fastener elements are achieved and the slider is automatically stopped.

Figure 5:
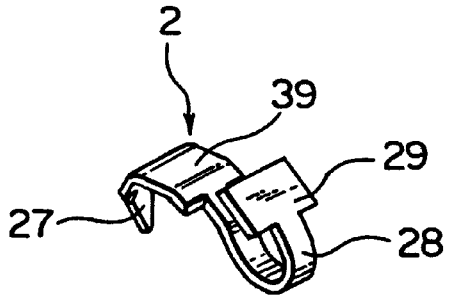
FIG. 5 is an exploded schematic perspective view of another embodiment of slider of a slider body further having an automatic locking mechanism according to the invention and showing only the slider body and the leaf spring thereof.
Figure 5:
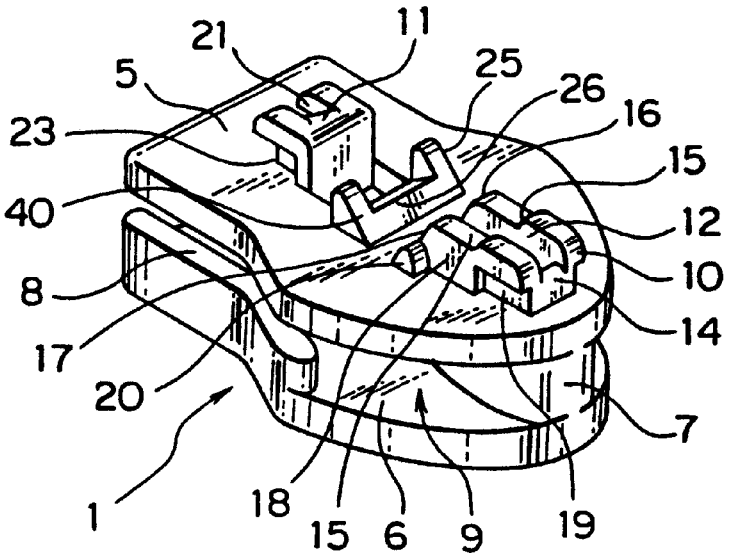
Figure 6:
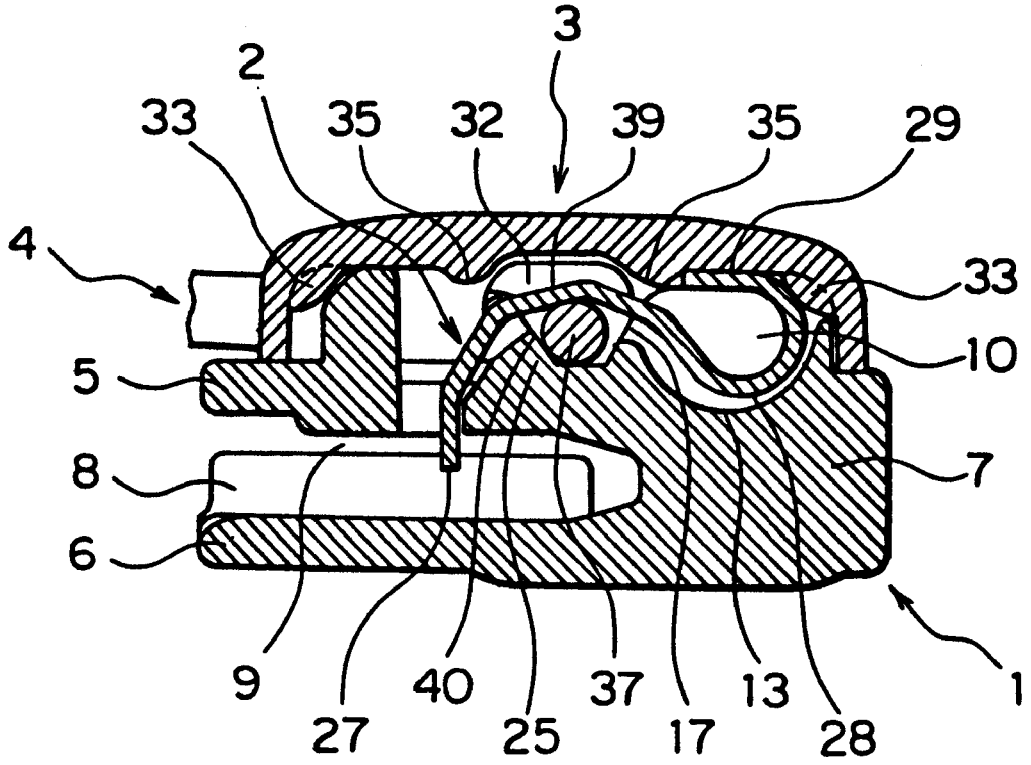
FIG. 6 is a cross sectional side view of the embodiment of FIG. 5.
Figure 7:
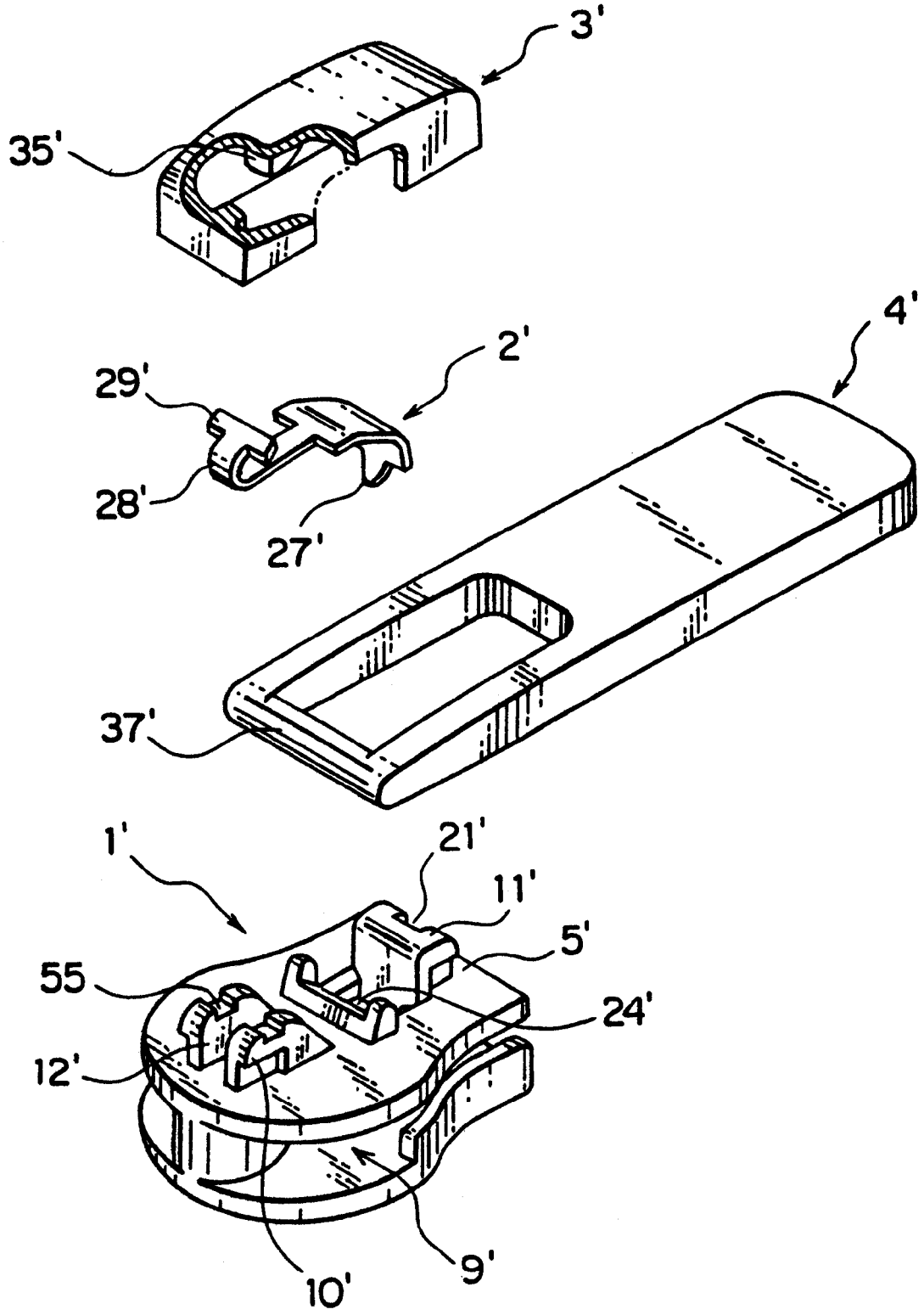
FIG. 7 PRIOR ART
FIG. 7 is an exploded schematic perspective view of a known slider of a slide fastener having an automatic locking mechanism.

Now, FIG. 5 shows a second embodiment of slider of a slide fastener with an automatic locking mechanism according to the invention. This embodiment is identical with the first embodiment in that the lug 10 formed on a front area of the slider body 1 has a center groove 12 of which bottom has an arcuate recess 13 that sinks into the guide post 7 and a low wall 14 is arranged in front of the groove 12 of the lug 10, but it differs from the first embodiment in that the stepped sections 15, 15 formed on the top of the lug 10 are horizontal until they get to the sloped rear end of the lug 10 and that the protuberant portion of the U-shaped resilient portion 28 of the leaf spring 2 has only a pair of lateral protuberances 29, 29 to form a T-shape so that the protuberances 29, 29 are received respectively on the horizontal stepped sections 15, 15 at the top of the lug 10.

On the other hand, the cover 3 has a pair of bent ridges 33, 33 projecting respectively from the front and rear inner corners between the top wall and each of the front and rear walls and having the same width as the groove 12 of the lug 10. The cover 3 has an inner profile that is flat from the base portions of the ridges 33, 33 toward the center of the cover 3 and adapted to press the protuberances 29, 29 of the leaf spring 2. The cover 3 further has a pair of ridge-like projections 35 formed on the inner surface of the cover 3 so as to abut on the top of the lug 10 and block the leaf spring 2 trying to move backward from there. The cover 3 furthermore has a flat center portion extending above and along the top edge of the axle-receiving slots 32, 32. The ridge-like projections 35, 35 are formed symmetrically with respect to a transversal plane of the cover 3 so that the cover 3 may be placed in position without regarding its orientation during the assembling process. The other parts of the second embodiment is identical with those of the first embodiment of FIG. 1, as well as the process of assembling the components and the procedure for operating the slider.

A slider of a slide fastener with an automatic locking mechanism according to the invention and provides the following advantages.

As described above, since a slider of a slide fastener with an automatic locking mechanism comprises a slider body 1 having a cover-attaching lug 10 located on an upper wing 5 of the slider body 1 near the front opening thereof, the cover-attaching lug 10 having a pair of stepped sections 15, 15, a longitudinal center groove 12, a recess 13 formed in the bottom of the groove 12 so as to sink into the top of the guide post 7 of the slider body 1, and a low wall section 14 formed in front of the groove 12 of the cover-attaching lug 10 to block the groove 12, a support lug 11 located on the upper surface of the upper wing 5 near a rear opening of the slider body 1, an S-shaped leaf spring 2 having a locking pawl 27 formed at an end thereof, a U-shaped resilient portion 28 to be received in the groove 12 of the cover-attaching lug 10, and a protuberant portion 29 at the opposite end, a cover 3 having a ridge-like projection 35 projecting downward from the inner surface of the cover 3 to abut on a corresponding end of the leaf spring 2 and a pull tab having an axle 37, the slider is made to show a compact and low profile, good in appearance and stable. Further, since the U-shaped resilient portion 28 of the S-shaped leaf spring 2 has an extended extremity, the resilient portion 28 can be deeply curved so that the leaf spring 2 may be larger, and is provided with an easy and strong resiliency, thus effectively serving the automatic locking mechanism smoothly and easily, although the slider can be processed and assembled without difficulty.

In a slider of a slide fastener with an automatic locking mechanism according to the invention, Since the cover 3 further has a pair of bent ridges 33, 33 formed at the front and rear inner corners separating the top wall and each of the front and rear walls of the cover 3 and having a profile adapted to that of the groove 12 of the cover-attaching lug 10 so that the ridges 33, 33 are snugly received in the groove 12 without forming any step between the wall section 14 of the slider body 1 and the inner surface of the cover 3, the lug 10 is effectively prevented from falling when the cover 3 is caulked and hence the slider can be assembled with ease. Additionally, the leaf spring 2 can be operated smoothly and, if the leaf spring 2 is not completely received in the recess 13 of the slider body 1 and the U-shaped resilient portion 28 is projecting upward from the wall section 14 in the process of assembling the slider, the inwardly tapered surfaces of the bent ridges 33, 33 can reliably guide the leaf spring 2 into the recess 13 of the groove 12 so that the slider body 1 and the cover 3 can be assembled easily and reliably.

Further, in a slider of a slide fastener with an automatic locking mechanism according to the invention, since the ridge-like projection 35 of the cover 3 is in a flat form extending centrally and fully between the lateral walls of the cover 3, a pair of small projections 34, 34 being formed at front and rear ends of the flat central projection 35 and projecting toward the corresponding corners 16, 16 of the cover-attaching lug 10, the flat central projection 35 and the small projections 34, 34 projecting downwardly as low as a top edge of the level of the axle-receiving slots 32, 32 of lateral walls 31, 31 of the cover 3 to abut on the leaf spring 2, the cover 3 has an inner profile adapted to securely holding the leaf spring 2 having a cross-shaped end portion and the leaf spring 2 can be housed stably in position and prevented from being unnecessarily pulled beyond the limit of elasticity and plastically deformed to lose its resiliency.

In a slider of a slide fastener with an automatic locking mechanism according to the invention, since the ridge-like projection 35 of the cover 3 in a form of a sharp transversal center ridge extending between the lateral walls 31, 31 of the cover 3 are symmetrically formed on the front and rear inner surface of the cover 3, respectively, so as to project toward the corresponding inner corners 16, 16 of the cover-attaching lug 10 and to abut on the leaf spring 2, and the cover 3 has a flat center portion between the sharp transversal ridges 35, 35 extending above and along a top edge of the axle-receiving slots 32, 32, the cover 3 has an inner profile adapted to securely hold the leaf spring 2 having a T-shaped front end and the leaf spring 2 can be housed stably in position and prevented from being unnecessarily pulled beyond the limit of elasticity and plastically deformed to lose its resiliency.

In a slider of a slide fastener with an automatic locking mechanism according to the invention, since the stepped sections 15, 15 are formed in a rear area of a top of the cover-attaching lug 10 at a side toward the rear opening of the slider body 1 and have respective slopes rising toward the respective inner corners 16, 16 so that the lateral protuberances 29, 29 of the protuberant portion of the leaf spring 2 may be snugly held in the stepped sections 15, 15 respectively, the leaf spring 2 can be stably and easily mounted on the cover-attaching lug 10 to facilitate the operation of automatic assembling of the slider and improve the productivity. Besides, the leaf spring 2 can be accurately held to the lug 10 so that it can be effectively prevented from moving unintendedly from the lug 10.

In a slider of a slide fastener with an automatic stopper mechanism according to the invention, since the stepped sections 15, 15 are formed in a rear area of the top of the cover-attaching lug 10 at a side toward the rear opening of the slider body 1 and are in a horizontal form extending to the respective inner corners 16, 16 so that the lateral protuberances 29, 29 of the protuberant portion of the leaf spring 2 may be snugly held in the stepped sections 15, 15 respectively, not only the molding process of the slider body 1 is easly done, but also the leaf spring 2 can be stably and easily mounted on the cover-attaching lug 10 to facilitate the operation of automatic assembling of the slider 1 and improve the productivity. Further, the surface of the cover 3 can be made flat, which makes the slider good in appearance. Furthermore, the leaf spring 2 can be accurately held to the lug 10 so that it can be effectively prevented from moving unintendedly from the lug 10.

In a slider of a slide fastener with an automatic locking mechanism according to the invention, since the S-shaped leaf spring 2 has at an end of the protuberant portion thereof an axial protuberance 30 projecting from the center of the protuberant portion in addition to a pair of lateral protuberances 29, 29 to form a cross, and a locking pawl at the opposite end thereof, such that the lateral protuberances 29, 29 of the protuberant portion of the spring leaf 2 abut with the respective small projections 34, 34 of the cover 3 and the axial protuberance 30 of the leaf spring 2 abut with the ridge-like projection 35 of the cover 3, the protuberant portion of the leaf spring 2 can be made rather long and hence stably hold the slider body 1, and the cover 3 and the leaf spring 2 can be made to stably abut with each other, thus the slider can be operated smoothly and reliably.

In a slider of a slide fastener with an automatic locking mechanism according to the invention, since the S-shaped leaf spring 2 simply has a pair of lateral protuberances, and a locking pawl at the opposite end thereof, such that the lateral protuberances 29, 29 of the protuberant portion of the leaf spring 2 abut with the ridge-like projection 35 extending between the lateral walls 31, 31 and on the top inner surface of the cover 3, the leaf spring 2 has a wide protuberant portion at its end so that the leaf spring 2 can stably and strongly held to the slider body 1 although it has a simple structure.

What is claimed:

1. A slider of a slide fastener with an automatic locking mechanism, comprising:

(a) a slider body composed of upper and lower wings joined together at their front ends by a guide post so as to define between the upper and lower wings a fastener-element guide channel, the upper wing having a locking-pawl-insertion hole communicating with the fastener-element guide channel;

(b) a cover-attaching lug located on an upper surface of the upper wing near a front opening of the slider body, the lug including a pair of stepped sections, a longitudinal center groove, a recess formed in the bottom of the groove so as to sink into the guide post, and a low wall section arranged in front of the groove so as to block the groove;

(c) a support lug located on the upper surface of the upper wing near a rear opening of the slider body;

(d) an S-shaped leaf spring having a locking pawl at an end thereof for normally projecting into said guide channel through the locking-pawl-insertion hole of the slider body when assembled, a U-shaped resilient portion to be received in said groove of said cover-attaching lug and extending into said recess in said groove, a protuberant portion at the opposite end thereof to be placed on said stepped sections respectively;

(e) a cover having at least one ridge-like projection projecting downward from an inner surface thereof for abutting on said protuberant portion of said leaf spring; and (f) a pull-tab having an axle to be placed between said slider body and said leaf spring;

wherein said cover further has a pair of bent ridges formed at a front and rear inner corners between a top wall and each of front and rear walls of said cover and having a profile adapted to that of the groove of the cover-attaching lug so that the ridges are received in the groove without forming any step between the wall section of the slider body and the inner surface of the cover.

2. A slider of a slide fastener according to claim 1, wherein said ridge-like projection of the cover is in a flat form extending centrally and fully between lateral walls of the cover, and a pair of small projections being formed at front and rear ends of the central flat projection and projecting toward the corresponding inner corners of said cover-attaching lug, the central flat projection and said small projections projecting downwardly as low as a top edge of axle-receiving slot of the lateral walls of the cover to abut on said leaf spring.

3. A slider of a slide fastener according to claim 2, wherein said S-shaped leaf spring has at an end of the protuberant portion thereof an axial protuberance projecting from a center of said protuberant portion in addition to a pair of lateral protuberances so as to form a cross, and said locking pawl at the opposite end thereof, such that the lateral protuberances of the protuberant portion of the leaf spring abut on the respective small projections of said cover and said axial protuberance of said leaf spring abut on the ridge-like projection of said cover.

4. A slider of a slide fastener according to claim 1, wherein said ridge-like projection of the cover is in a form of a sharp transversal ridge extending between the lateral walls of the cover and formed on the front and rear portions of a top inner surface of the cover, respectively, so as to project toward the corresponding inner corners of the cover-attaching lug and to abut on said leaf spring, said cover having a flat center portion between said sharp transversal ridges extending above and along a top edge of an axle-receiving slot.

5. A slider of a slide fastener according to claim 4, wherein said S-shaped leaf spring has a pair of lateral protuberances, and said locking pawl at the opposite end thereof, such that the lateral protuberances of the protuberant portion of the leaf spring abut on the ridge-like projection extending between the lateral walls and on the top inner surface of the cover.

6. A slider of a slide fastener according to claim 1, wherein said stepped sections are formed in a rear area of a top of the cover-attaching lug at a side toward the rear opening of said slider body and have respective slopes rising toward the respective inner corners so that lateral protuberances of said protuberant portion of said leaf spring may be held in said stepped sections respectively.

7. A slider of a slide fastener according to claim 1, wherein said stepped sections are formed in a rear area of a top of the cover-attaching lug at a side toward the rear opening of said slider body and are in horizontal form extending to respective inner corners so that lateral protuberances of said protuberant portion of said leaf spring may be held in said stepped sections respectively.

8. A slider of a slide fastener with an automatic locking mechanism, comprising:

(a) a slider body composed of upper and lower wings joined together at their front ends by a guide post so as to define between the upper and lower wings a fastener-element guide channel, the upper wing having a locking-pawl-insertion hole communicating with the fastener-element guide channel;

(b) a cover-attaching lug located on an upper surface of the upper wing near a front opening of the slider body, the lug including a pair of stepped sections, a longitudinal center groove, a recess formed in the bottom of the groove so as to sink into the guide post, and a low wall section arranged in front of the groove so as to block the groove;

(c) a support lug located on the upper surface of the upper wing near a rear opening of the slider body;

(d) an S-shaped leaf spring having a locking pawl at an end thereof for normally projecting into said guide channel through the locking-pawl-insertion hole of the slider body when assembled, a U-shaped resilient portion to be received in said groove of said cover-attaching lug and extending into said recess in said groove, a protuberant portion at the opposite end thereof to be placed on said stepped sections respectively;

(e) a cover having at least one ridge-like projection projecting downward from an inner surface thereof for abutting on said protuberant portion of said leaf spring; and (f) a pull-tab having an axle to be placed between said slider body and said leaf spring;

wherein said ridge-like projection of the cover is in a flat form extending centrally and fully between lateral walls of the cover, and a pair of small projections being formed at front and rear ends of the central flat projection and projecting toward the corresponding inner corners of said cover-attaching lug, the central flat projection and said small projections projecting downwardly as low as a top edge of axle-receiving slots of the lateral walls of the cover to abut on said leaf spring.

9. A slider of a slide fastener according to claim 8, wherein said cover further has a pair of bent ridges formed at a front and rear inner corners between a top wall and each of front and rear walls of said cover and having a profile adapted to that of the groove of the cover-attaching lug so that the ridges are received in the groove without forming any step between the wall section of the slider body and the inner surface of the cover.

10. A slider of a slide fastener according to claim 8, wherein said S-shaped leaf spring has at an end of the protuberant portion thereof an axial protuberance projecting from a center of said protuberant portion in addition to a pair of lateral protuberances so as to form a cross, and said locking pawl at the opposite end thereof, such that the lateral protuberances of the protuberant portion of the leaf spring abut on the respective small projections of said cover and said axial protuberance of said leaf spring abut on the ridge-like projection of said cover.

11. A slider of a slide fastener according to claim 8, wherein said stepped sections are formed in a rear area of a top of the cover-attaching lug at a side toward the rear opening of said slider body and have respective slopes rising toward the respective inner corners so that lateral protuberances of said protuberant portion of said leaf spring may be held in said stepped sections respectively.

12. A slider of a slide fastener according to claim 8, wherein said stepped sections are formed in a rear area of a top of the cover-attaching lug at a side toward the rear opening of said slider body and are in horizontal form extending to respective inner corners so that lateral protuberances of said protuberant portion of said leaf spring may be held in said stepped sections respectively.

13. A slider of a slide fastener with an automatic locking mechanism, comprising:

(a) a slider body composed of upper and lower wings joined together at their front ends by a guide post so as to define between the upper and lower wings a fastener-element guide channel, the upper wing having a locking-pawl-insertion hole communicating with the fastener-element guide channel;

(b) a cover-attaching lug located on an upper surface of the upper wing near a front opening of the slider body, the lug including a pair of stepped sections, a longitudinal center groove, a recess formed in the bottom of the groove so as to sink into the guide post, and a low wall section arranged in front of the groove so as to block the groove;

(c) a support lug located on the upper surface of the upper wing near a rear opening of the slider body;

(d) an S-shaped leaf spring having a locking pawl at an end thereof for normally projecting into said guide channel through the locking-pawl-insertion hole of the slider body when assembled, a U-shaped resilient portion to be received in said groove of said cover-attaching lug and extending into said recess in said groove, a protuberant portion at the opposite end thereof to be placed on said stepped sections respectively;

(e) a cover having at least one ridge-like projection projecting downward from an inner surface thereof for abutting on said protuberant portion of said leaf spring; and (f) a pull-tab having an axle to be placed between said slider body and said leaf spring;

wherein said ridge-like projection of the cover is in a form of a sharp transversal ridge extending between the lateral walls of the cover and formed on the front and rear portions of a top inner surface of the cover, respectively, so as to project toward the corresponding inner corners of the cover-attaching lug and to abut on said leaf spring, said cover having a flat center portion between said sharp transversal ridges extending above and along a top edge of an axle-receiving slot.

14. A slider of a slide fastener according to claim 13, wherein said cover further has a pair of bent ridges formed at a front and rear inner corners between a top wall and each of front and rear walls of said cover and having a profile adapted to that of the groove of the cover-attaching lug so that the ridges are received in the groove without forming any step between the wall section of the slider body and the inner surface of the cover.

15. A slider of a slide fastener according to claim 13, wherein said S-shaped leaf spring has a pair of lateral protuberances, and said locking pawl at the opposite end thereof, such that the lateral protuberances of the protuberant portion of the leaf spring abut on the ridge-like projection extending between the lateral walls and on the top inner surface of the cover.

16. A slider of a slide fastener according to claim 13, wherein said stepped sections are formed in a rear area of a top of the cover-attaching lug at a side toward the rear opening of said slider body and have respective slopes rising toward the respective inner corners so that lateral protuberances of said protuberant portion of said leaf spring may be held in said stepped sections respectively.

17. A slider of a slide fastener according to claim 13, wherein said stepped sections are formed in a rear area of a top of the cover-attaching lug at a side toward the rear opening of said slider body and are in horizontal form extending to respective inner corners so that lateral protuberances of said protuberant portion of said leaf spring may be held in said stepped sections respectively.

* * * * *